US005953753A

United States Patent [19]

Perez

[11] Patent Number: 5,953,753

[45] Date of Patent: Sep. 21, 1999

[54] CAPE FOR HAIR CUTTING

[76] Inventor: Clara M. Perez, 4046 W. Argyle, Chicago, Ill. 60630

[21] Appl. No.: 08/861,646

[22] Filed: May 22, 1997

[51] Int. Cl.[6] ..... A41D 3/08; A41D 13/04

[52] U.S. Cl. ..... 2/50; 2/48; 2/912

[58] Field of Search ..... 2/50, 49.1, 48, 2/49.2, 49.3, 49.4, 49.5, 51, 52, 60, 912, 916, 908; D2/860, 861, 862

[56] References Cited

U.S. PATENT DOCUMENTS

| | | | |
|---|---|---|---|
| Re. 24,043 | 7/1955 | Barager . | |
| 1,503,117 | 7/1924 | Crawford et al. . | |
| 2,093,483 | 9/1937 | Sackett | 2/50 |
| 2,116,685 | 5/1938 | Nicolet . | |
| 2,289,526 | 7/1942 | Tapper | 2/50 |
| 2,544,487 | 3/1951 | Caluthis | 2/50 |
| 2,552,462 | 5/1951 | Savrin . | |
| 2,744,252 | 5/1956 | Cansler | 2/50 |
| 2,851,690 | 9/1958 | Jennings . | |
| 3,184,883 | 5/1965 | McCook . | |
| 3,308,479 | 3/1967 | Sesco | 2/50 |
| 4,280,227 | 7/1981 | Brock | 2/50 X |
| 4,615,047 | 10/1986 | Matsuoka | 2/50 |
| 4,723,323 | 2/1988 | Wright | 2/48 |
| 5,079,777 | 1/1992 | Fowler et al. . | |
| 5,572,740 | 11/1996 | Geniesse | 2/50 X |

*Primary Examiner*—Michael A. Neas
*Assistant Examiner*—Shirra L. Jenkins
*Attorney, Agent, or Firm*—Michael R. McKenna

[57] ABSTRACT

A cape for hair cutting having a feature which prevents cut hair from clogging the neck closure. Additionally, the cape has a resiliently connected toy which can be accessible for play by a child.

13 Claims, 2 Drawing Sheets

CAPE FOR HAIR CUTTING

BACKGROUND OF THE INVENTION

A cape for haircutting adapted to be worn by a person receiving a haircut or like hair services comprising a first sheet of fabric having a neck opening which is formed from a continuous piece of material with a centrally located neck opening. Along the edge of the neck opening a means for securing a first end to a second end to form a neck opening is provided. Means for shielding having a free end is also provided.

The means for shielding extends from the inner surface of the first sheet of fabric along a third portion of the neck opening proximate to one end of the edge over the means for fastening with the free end disposed proximate to the outside surface of the cape to prevent loose cut hair from becoming lodged in the means for securing.

Fastening means for the neck opening comprise interlocking surfaces fitted to coincide with the upper edge of the neck opening. The principle disadvantage of the prior art capes is that loose hair can be caught in the fastening means thereby rendering it hygienically and aesthetically unclean particularly to the wearer of the cape. If sufficient loose hair is lodged in the fastening means, the fastening means will operate less efficiently.

An alternative embodiment of the instant invention provides a cape for hair cutting adapted to be worn by a person receiving a hair cut or the like comprising at least one ornament and means for resiliently attaching the at least one ornament to the outer surface of the cape. The means for resiliently attaching is adapted to allow the ornament to move between a first position and a second position relative to the cape, whereby, the ornament is accessible to a person wearing the cape while receiving a hair cut.

Background technology is available in the form of a cape in accord with U.S. Pat. No. Des. 308,437 issued to Baldwin et.al. in 1990 which reveals a reversible cape for shampooing, haircutting, or the like which also utilizes a fastening means which may be disposed to catching loose hair, particularly at the edge of the neck opening.

See also U.S. Pat. No. 1,216,088 issued to De Vingo in 1917 which utilizes snap fastener. While snap fastening will likely collect less loose hair than hook and loop material fasteners, the means for shielding taught by the instant invention may still be used in connection with these snap fasteners to alleviate this inherent disadvantage.

U.S. Pat. No. 1,979,879 issued to Harris in 1934 reveals a combined apron and toilet case. Said apron has a neck opening with a bib or collar that is disposed on the outside of the apron so that it can be folded over the edge of the neck opening and tucked under the garment in between the garment (i.e. the dress of the wearer) and the body of the wearer. This bib or collar serves to encase the neck opening of the dress to protect it from liquid solutions that are used in salons.

See also U.S. Pat. No. Des. 300,281 for a combination bid with a pacifier holder; U.S. Pat. No. Des. 242,503 for a combined bib and pacifier; U.S. Pat. No. Des. 65,544 for a child's apron; and U.S. Pat. No. Des. 318,122 for a pacifier holder. These patents all teach the ability to hang objects from the front of a bid or cloak-like apron.

Some of the drawbacks to these designs are that they do not prevent loose cut hair from becoming lodged in the means for securing. Moreover, some of the drawbacks to the pacifier apron designs are that they do not allow for the enhanced movement of playful ornaments away from and returning to the wearer of the apron, specifically a child having a haircut. Children and haircuts are often a disaster in terms of occupying the child's mind while the cutting takes place. Children are known to fidget in the barber's chair causing delays and creating safety concerns for the hair cutter and the on looking parent.

To alleviate these problems, and others which will become apparent from the disclosure which follows, the present invention conveniently prevents loose cut hair from becoming lodged in the means for securing, particularly hook and loop fasteners and it gives children a responsive toy to play with during the hair cutting ordeal.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing devices which teach structures that generally shield the person having his or her hair cut from the falling cut hair, this important invention shield the neck opening securing means from having loose cut hair from becoming lodged therein. Accordingly, the user of this cape has an unimpeded means for fastening, even after several haircuts. Moreover, the cape, without loose cut hair trapped in its closure means, is cleaner in appearance throughout the hair cutter's day.

Other advantages of the present invention include ornaments that are resiliently attached to the cape are items which would be attractive to young children. For it is the purpose of these ornaments that they entertain a youngster while being groomed. Children are notoriously active and impatient in a barber's chair. They have been known to squirm and move and not generally stay still. The instant invention provides resiliently attached ornaments which can be played with by a young child to pass the time as his or her hair is being cut. This improved toy diversion will reduce annoyances to the hair cutter and safety hazards as well.

Still other advantages will be apparent from the disclosure that follows.

SUMMARY OF THE INVENTION

The invention relates to a cape for hair cutting adapted to be worn by a person receiving a hair cut or the like comprising a first sheet of fabric having an inner surface and an outer surface and having a peripheral edge with an edge segment with a first end and a second end. The edge segment having means for securing the first end to the second end to form a neck opening.

The means for securing comprises means for fastening disposed along a first portion of the neck opening proximate to the first end of the edge segment and complementary means for fastening disposed along a second portion of the neck opening proximate to the second end of the edge segment. The first portion of the neck opening along which the means for fastening is disposed is substantially the same length as the second portion of the neck opening along which the complementary means for fastening is disposed. The complementary means for fastening is adapted to be reversibly engagable to the means for fastening.

Means for shielding having a free end is also provided. The means for shielding extends from the inner surface of the first sheet of fabric along a third portion of the neck opening proximate to one end of the edge segment. The third portion of the neck opening along which the means for shielding is disposed is at least as long as the first portion and the second portion of the neck opening along which the means for fastening and complementary means for fastening are respectively disposed.

The means for shielding is adapted to be extended over the means for fastening which is reversibly engaged to the complementary means for fastening with the free end disposed proximate to the outside surface of the cape to prevent loose cut hair from becoming lodged in the means for securing. Clearly, the means for shielding may be an integral portion of the first sheet of fabric or a separate piece of fabric attached thereto.

An alternative embodiment of the instant invention provides a cape for hair cutting adapted to be worn by a person receiving a hair cut or the like comprising at least one ornament and means for resiliently attaching the at least one ornament to the outer surface of the cape. The means for resiliently attaching is adapted to allow the ornament to move between a first position and a second position relative to the cape, whereby, the ornament is accessible to a person wearing the cape while receiving a hair cut.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 1:
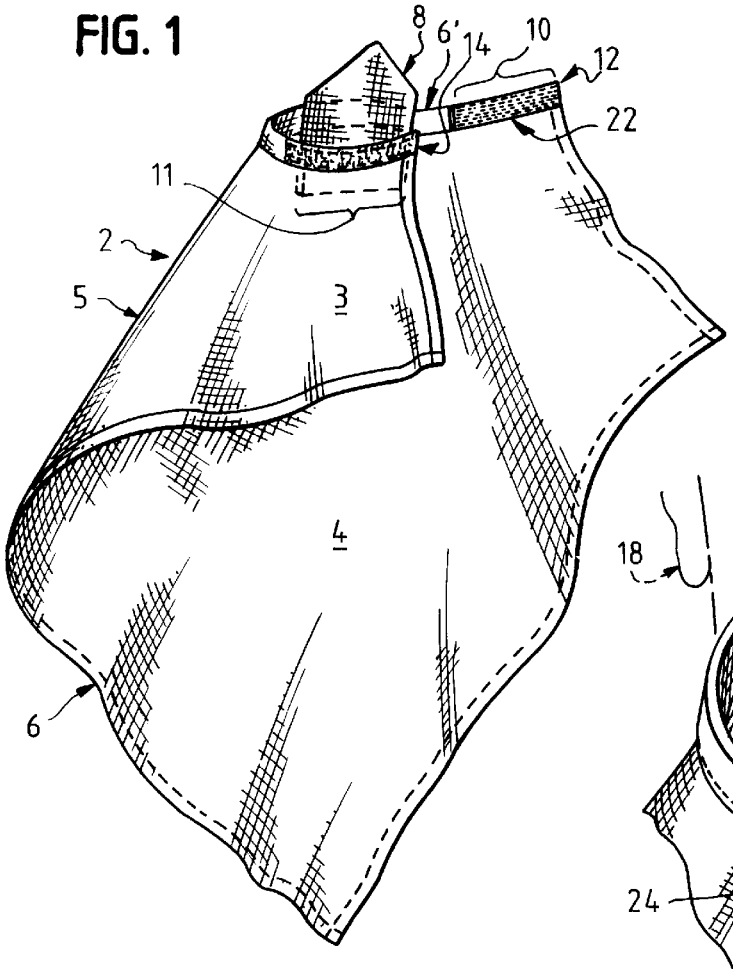
FIG. 1 is a perspective view of a first preferred embodiment of the cape for hair cutting of the present invention arranged with the means for shielding disposed along a portion of the neck opening adjacent to means for fastening and with the other end of the neck opening on which the complementary means is disposed being unengaged to the means for fastening.

The preferred embodiments depicted in the drawing include a cape for hair cutting adapted to be worn by a person receiving a hair cut or the like with means for shielding adapted to prevent loose cut hair from becoming lodged in the means for securing. Alternative embodiments of the instant invention provides a cape with at least one ornament and means for resiliently attaching the at least one ornament to the outer surface of the cape.

Without departing from the generality of the invention disclosed herein, the discussion that follows, without limiting the scope of the invention, will refer to the invention as depicted in the drawing.

Figure 2:
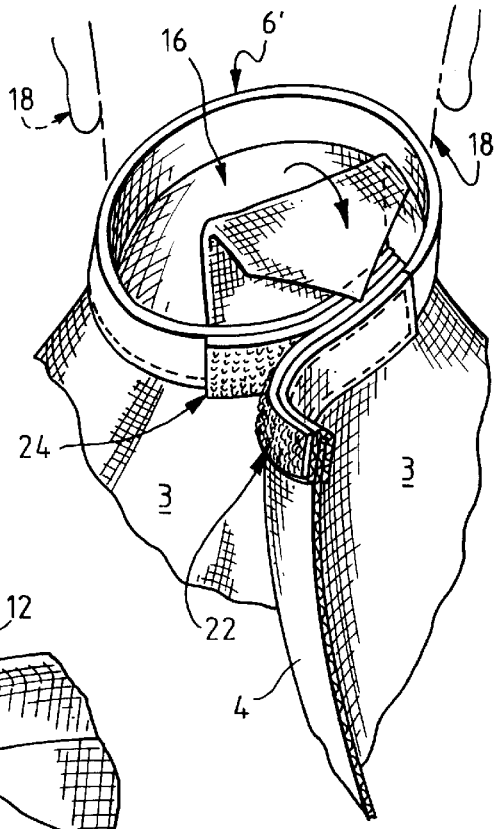
FIG. 2 is a fragmentary perspective view of the first preferred embodiment of the cape for hair cutting of the present invention showing the means for fastening partially engaged to the complementary means for fastening.

The cape 2 for hair cutting adapted to be worn by a person receiving a hair cut or the like comprising a first sheet of fabric 5 having an inner surface 4 and an outer surface 3 the peripheral edge has an edge segment with the first end 12 and a second end 14. The edge segment 6' has means for securing 25, the first end 12 to the second end 14 to form a neck opening 16, as best shown in FIG. 2.

The means for securing 25 comprises means for fastening 22 disposed along a first portion 10 of the neck opening 16 proximate to the first end 12 of the edge segment 6' and further comprising complementary means for fastening 24 disposed along a second portion 11 of the neck opening 16 proximate to the second end 14 of the edge segment 6'.

The first portion 10 of the neck opening 16 along which the means for fastening 22 is disposed is substantially the same length as the second portion 11 of the neck opening 16 along which the complementary means for fastening 24 is disposed. The complementary means for fastening is adapted to be reversibly engageable to the means for fastening, as shown in FIG. 2.

Figure 3:
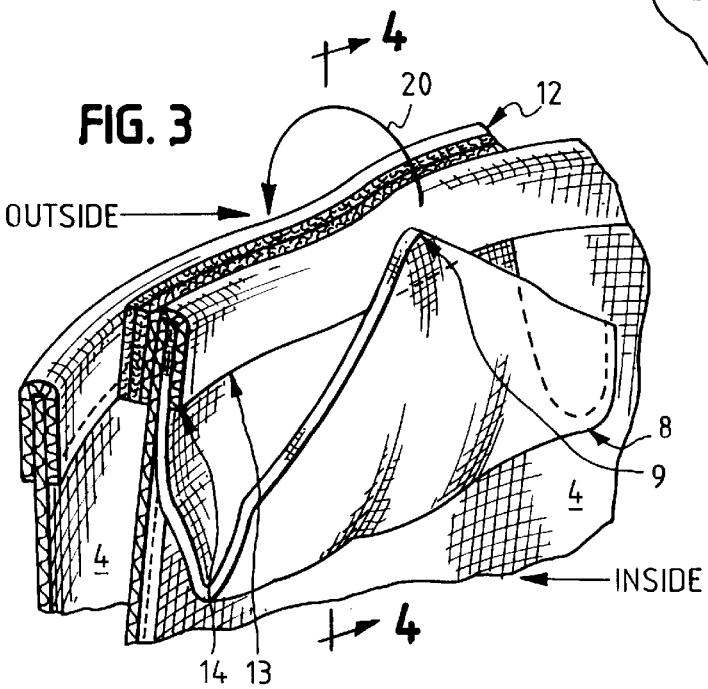
FIG. 3 is a fragmentary perspective view of the first preferred embodiment of FIG. 1 showing the means for fastening engaged to the complementary means for fastening with the means for shielding positioned to be extended over the means for securing to prevent loose cut hair from becoming lodged therein.

As best shown in FIG. 3 means for shielding 8 have a free end 9. Means for shielding extends from the inner surface 4 of the first sheet of fabric 5 along a third portion 13 of the neck opening 16 proximate to one end of the edge segment 6'. The third portion 13 of the neck opening 16 along which the means for shielding 8 is disposed is at least as long as the first portion 10 and the second portion 11 of the neck opening 16 along which the means for fastening 22 and complementary means for fastening 24 are respectively disposed.

A means for shielding is adapted to be extended over the means for fastening 22 which is reversibly engaged through the complementary means for fastening 24 with the free end 9 disposed proximate to the outside surface 3 of the cape 2 to prevent loose cut hair from becoming lodged in the means for securing 25. This is illustrated in FIG. 4 where the means for shielding has been extended thusly.

Figure 4:
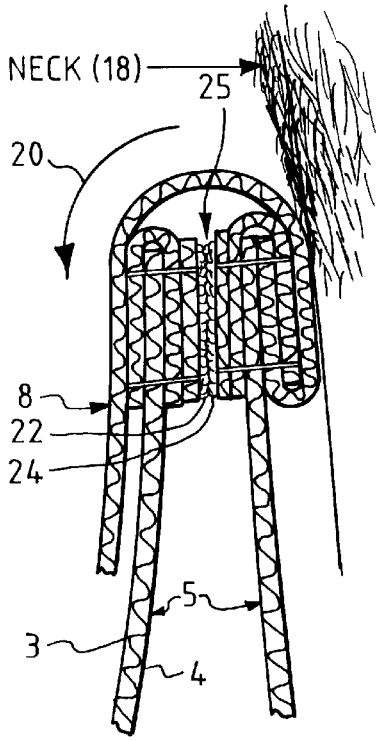
FIG. 4 is a fragmentary side elevation view taken along the line 4—4 of FIG. 3 showing the means for securing extending from the inner surface of the cape out over the top of the means for securing to prevent loose cut hair from becoming lodged therein.

As illustrated in FIG. 4 the means for shielding may be disposed when the cape in association with the means for fastening or with the complementary means for fastening. As shown in the drawing the means for shielding may comprise a flexible protrusion. The flexible protrusion may be a section of fabric extending beyond the edge segment or it may comprise a second sheet of fabric attached to the cape adjacent to the neck opening and adapted to cover the means for securing.

While any known means for securing two sections of fabric can be utilized, the means for shielding is particularly advantageous where the means for securing comprises hook and loop material since such material is apt to allow loose cut hair to become lodged therein.

Illustrated in FIG. 2 of the drawing, means for fastening comprising a section of loop material and the complementary means for fastening comprising a section of hook material. The reverse can readily be understood.

Figure 5:
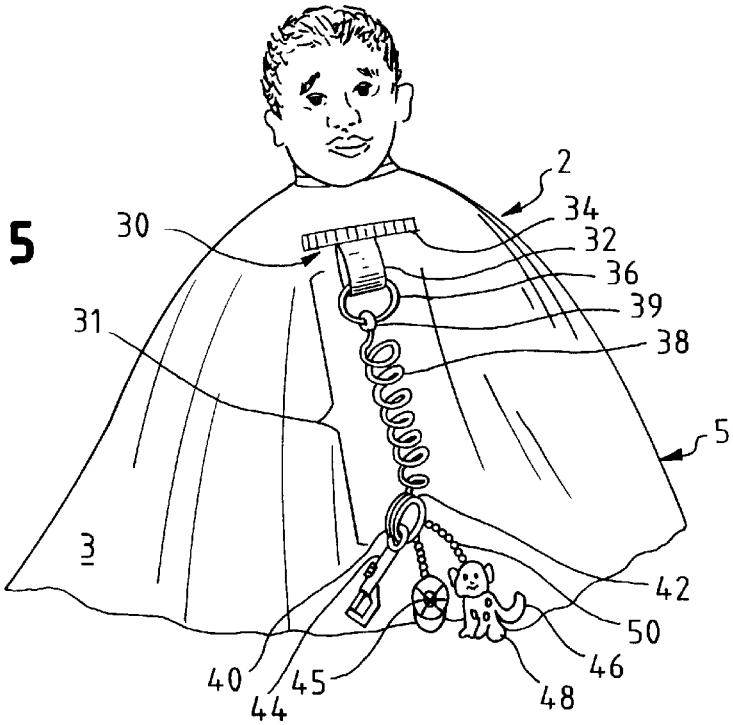
FIG. 5 is a perspective view of a second preferred embodiment of the cape for hair cutting of the present invention showing a means for resiliently attaching ornaments to the outer surface of the cape.

In another preferred embodiment of the instant invention, as shown in FIG. 5 a cape comprised of at least one ornament and a means for attaching at least one ornament to the outer surface of the first sheet of fabric. As shown in FIG. 5 a variety of ornaments are shown as numbers 44, 46, and 48 respectively. The positioning of the ornaments is such that they are accessible to a person, particularly a child, wearing the cape 2 while receiving a hair cut.

In another embodiment of the instant invention, a cape 2 is adapted to be worn by a person receiving a hair cut or like comprising a first sheet fabric 5 having an inner surface 4 and an outer surface 3 and having a peripheral edge 6 with the peripheral edge having an edge segment 6'. The edge segment has a first end 12 and a second end 14. The edge segment has means to secure the first end to the second end to form a neck opening 16. The means for securing comprises means for fastening disposed along a first portion of the neck opening proximate to the first end.

The means for securing 25 comprises means for fastening 22 disposed along a first portion 10 of the neck opening 16 proximate to the first end 12 of the edge segment 6' and complementary means for fastening 24 disposed along a second portion 11 of the neck opening 16 proximate to the second end 14 of the edge segment 6'. The first portion 10 of the neck opening along which the means for fastening is disposed is substantially the same length as the second portion of the neck opening along which the complementary means for fastening is disposed. The complementary means for fastening is adapted to be reversibly engagable to the means for fastening. The cape 2 further comprises, as best shown in FIG. 5, at least one ornament (44, 46, or 48) and means for resiliently attaching 31 the at least one ornament to the outer surface 3 of the first sheet of fabric 5. The means for resiliently attaching 31 is adapted to allow the ornament to move between a first position and a second position relative to the first sheet of fabric.

This preferred embodiment may further comprise means for shielding 8 disposed on the inner surface 4 of the first sheet of fabric 5 in operative association with the means for securing to protect it from loose cut hair becoming lodged therein.

As shown in FIG. 5, the means for resiliently attaching 31 comprises a resilient cord 38 having a proximal end 39 engaged to the outer surface 3 of the first sheet of fabric 5 and a distal end 42 with means for joining the at least one ornament thereto. The resilient cord may be coiled as shown in FIG. 5. The means for joining may comprise a key ring 40 and any other suitable connector.

In another preferred embodiment of the instant invention, a cape for hair cutting adapted to be worn by a person receiving a hair cut or the like comprising a first sheet of fabric 5 having an inner surface 4, an outer surface 3, and having a peripheral edge 6. The peripheral edge has an edge segment 6' with a first end 12 and a second end 14. The edge segment 6' has means for securing 25 the first end 12 to the second end 14 to form a neck opening 16. The means for securing 25 comprises means for fastening 22 disposed along a first portion 10 of the neck opening 16 proximate to the first end 12 of the edge segment 6' and complementary means for fastening 24 disposed along a second portion 11 of the neck opening 16 proximate to the second end 14 of the edge segment 6'. The first portion 11 of the neck opening 16 along which the means for fastening 22 is disposed is substantially the same length as the second portion 11 of the neck opening along which the complementary means for fastening is disposed and the complementary means for fastening 24 is adapted to be reversibly engagable to the means for fastening.

Means for shielding 8 are provided with a free end 9. The means for shielding extend from the inner surface 4 of the first sheet of fabric 5 along a third portion 13 of the neck opening 16 proximate to one end of the edge segment 6'. The third portion 13 of the neck opening along which the means for shielding is disposed is at least as long as the first portion 10 and the second portion 11 of the neck opening along which the means for fastening and complementary means for fastening are respectively disposed. The means for shielding is adapted to be extended over the means for fastening which is reversibly engaged to the complementary means for fastening with the free end 9 disposed proximate to the outside surface 3 of the cape 2 to prevent loose cut hair from becoming lodged in the means for securing.

This preferred embodiment of the instant invention further has at least one ornament comprising at least one child's toy having a rattle, and means for resiliently attaching 31 the at least one ornament to the outer surface 3 of the first sheet of fabric 5 which comprises a resilient cord 38 having a proximal end 39 connected to the outer surface 3 of the first sheet of fabric 5 and a distal end 42 with means for joining the at least one ornament thereto.

The means for resiliently attaching 38 is adapted to allow the ornament to move between a first position and a second position relative to the first sheet of fabric so that the ornament is accessible to a person wearing the cape while receiving a hair cut.

In another preferred embodiment, a cape for hair cutting adapted to be worn by a person receiving a hair cut or the like comprising a first sheet of fabric 5 having an inner surface 4 and an outer surface 3, at least one ornament, and means for resiliently attaching the at least one ornament to the outer surface 3 of the first sheet of fabric. The means for resiliently attaching is adapted to allow the ornament to move between a first position and a second position relative to the first sheet of fabric, whereby, the ornament is accessible to a person wearing the cape while receiving a hair cut.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

Further, the purpose of the foregoing abstract is to enable the U.S. Patent and Trademark Office and the public generally, and especially the scientist, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is tit intended to be limiting as to the scope of the invention in any way.

The invention resides not in any one of these features per se, but rather in the particular combination of all of them herein disclosed and claimed and it is distinguished from the prior art in this particular combination of all of its structures for the function specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

What is claimed as being new and desired to be protected by Letters Patent of the United States is as follows:

1. A cape for hair cutting adapted to be worn by a person receiving a hair cut comprising:

a. a first sheet of fabric having an inner surface and an outer surface and having a peripheral edge, said peripheral edge having an edge segment with a first end and a second end, said edge segment having means for securing the first end to the second end to form a neck opening, said means for securing comprising means for fastening disposed on the inner surface along a first portion of the neck opening proximate to the first end of the edge segment and complementary means for fastening disposed on the outer surface along a second portion of the neck opening proximate to the second end of the edge segment, the first portion of the neck opening along which the means for fastening is disposed is substantially the same length as the second portion of the neck opening along which the complementary means for fastening is disposed, said complementary means for fastening is adapted to be reversibly engagable to the means for fastening; and b. means for preventing loose cut hair from becoming lodged in the means for securing comprising means for shielding, said means for shielding being attached to and extending from the inner surface of the first sheet of fabric opposite the second portion of the neck opening with a length along said neck opening that is substantially the same as the length of the second portion and having a free end, said means for shielding being movable between a first position in which the free end is disposed remote from the means for fastening and a second position in which the free end extends over the means for fastening which is reversibly engaged to the complementary means for fastening with the free end disposed proximate to the outside surface of the cape to prevent loose cut hair from becoming lodged in the means for securing.

2. The cape of claim 1, wherein the means for shielding comprises a flexible protrusion.

3. The cape of claim 2, wherein the flexible protrusion comprises a second sheet of fabric attached to the cape adjacent to the neck opening and adapted to cover the meant for securing.

4. The cape of claim 1, wherein the means for fastening comprises a section of hook material and the complementary means for fastening comprises a section of loop material.

5. The cape of claim 1, further comprising at least one ornament and means for attaching said at least one ornament to the outer surface of the first sheet of fabric, whereby, said ornament is accessible to a person wearing the cape while receiving a hair cut.

6. A cape for hair cutting adapted to be worn by a person receiving a hair cut comprising:

a. a first sheet of fabric having an inner surface and an outer surface and having a peripheral edge, said peripheral edge having an edge segment with a first end and a second end, said edge segment having means for securing the first end to the second end to form a neck opening, said means for securing comprising means for fastening disposed on the inner surface along a first portion of the neck opening proximate to the first end of the edge segment and complementary means for fastening disposed on the outer surface along a second portion of the neck opening proximate to the second end of the edge segment, the first portion of the neck opening along which the means for fastening is disposed is substantially the same length as the second portion of the neck opening along which the complementary means for fastening is disposed, said complementary means for fastening is adapted to be reversibly engagable to the means for fastening;

b. at least one ornament;

c. means for resiliently attaching said at least one ornament to the outer surface of the first sheet of fabric, said means for resiliently attaching adapted to allow the ornament to move between a first position and a second position relative to said first sheet of fabric, and d. means for preventing loose cut hair from becoming lodged in the means for securing including means for shielding disposed on the inner surface of the first sheet of fabric opposite the second portion of the neck opening with a length along said neck opening that is substantially the same as the length of the second portion in operative association with the means for securing and having a free end, said means for shielding being movable between a first position in which the free end is disposed remote from the means for fastening and a second position in which the free end extends over the means for fastening which is reversibly engaged to the complementary means for fastening with the free end disposed proximate to the outside surface of the cape to prevent loose cut hair from becoming lodged in the means for securing, whereby, the means for securing is protected from loose cut hair becoming lodged therein.

7. The cape of claim 6, wherein means for resiliently attaching comprises a resilient cord having a proximal end engaged to the outer surface of the first sheet of fabric and a distal end with means for joining said at least one ornament thereto.

8. The cape of claim 7, wherein the resilient cord is coiled.

9. The cape of claim 7, wherein the means for joining comprises a key ring.

10. The cape of claim 7, wherein said means for joining comprises a clip for reversibly attaching objects.

11. The cape of claim 6, wherein said at least one ornament comprises at least one child's toy.

12. The cape of claim 6, wherein said at least one ornament comprises a rattle.

13. A cape for hair cutting adapted to be worn by a person receiving a hair cut comprising:

a. a first sheet of fabric having an inner surface and an outer surface and having a peripheral edge, said peripheral edge having an edge segment with a first end and a second end, said edge segment having means for securing the first end to the second end to form a neck opening, said means for securing comprising means for fastening disposed on the inner surface along a first portion of the neck opening proximate to the first end of the edge segment and complementary means for fastening disposed on the outer surface along a second portion of the neck opening proximate to the second end of the edge segment, the first portion of the neck opening along which the means for fastening is disposed is substantially the same length as the second portion of the neck opening along which the complementary means for fastening is disposed, said complementary means for fastening is adapted to be reversibly engagable to the means for fastening;

b. means for preventing loose cut hair from becoming lodged in the means for securing comprising means for shielding, said means for shielding having a free end and extending from the inner surface of the first sheet of fabric opposite the second portion of the neck opening with a length along said neck opening that is substantially the same as length of the second portion and having a free end, said means for shielding being movable between a first position in which the free end is disposed remote from the means for fastening and a second position in which the free end extends over the means for fastening which is reversibly engaged to the complementary means for fastening with the free end disposed proximate to the outside surface of the cape to prevent loose cut hair from becoming lodged in the means for securing;

c. at least one ornament comprises at least one child's toy having a rattle; and d. means for resiliently attaching said at least one ornament to the outer surface of the first sheet of fabric comprising a resilient cord having a proximal end connected to the outer surface of the first sheet of fabric and a distal end with means for joining said at least one ornament thereto, said means for resiliently attaching adapted to allow the ornament to move between a first position and a second position relative to said first sheet of fabric, whereby, said ornament is accessible to a person wearing the cape while receiving a hair cut.

* * * * *